US008137088B2

(12) United States Patent
Boscolo et al.

(10) Patent No.: US 8,137,088 B2
(45) Date of Patent: Mar. 20, 2012

(54) DEVICE FOR DEPOSITING SYNTHETIC FIBERS TO FORM A NONWOVEN WEB

(75) Inventors: Galliano Boscolo, Vigliano-Biella (IT); Hans-Holger Heesch, Neumünster (DE)

(73) Assignee: Oerlikon Textile GmbH & Co. KG (DE)

( * ) Notice: Subject to any disclaimer, the term of this patent is extended or adjusted under 35 U.S.C. 154(b) by 874 days.

(21) Appl. No.: 11/575,843

(22) PCT Filed: Sep. 23, 2005

(86) PCT No.: PCT/EP2005/010308
§ 371 (c)(1),
(2), (4) Date: May 29, 2008

(87) PCT Pub. No.: WO2006/032517
PCT Pub. Date: Mar. 30, 2006

(65) Prior Publication Data

US 2008/0317895 A1 Dec. 25, 2008

(30) Foreign Application Priority Data

Sep. 24, 2004 (DE) ..... 10 2004 046 309

(51) Int. Cl.
*B29C 47/90* (2006.01)

(52) U.S. Cl. ..... 425/72.2; 425/83.1

(58) Field of Classification Search ..... 425/66, 425/72.2, 83.1
See application file for complete search history.

(56) References Cited

U.S. PATENT DOCUMENTS

| | | | | |
|---|---|---|---|---|
| 2,460,899 | A | 2/1949 | Modigliani et al. | |
| 3,611,508 | A * | 10/1971 | Reinhall et al. | 264/518 |
| 4,111,294 | A * | 9/1978 | Carpenter et al. | 198/381 |
| 5,460,500 | A * | 10/1995 | Geus et al. | 425/66 |
| 5,814,349 | A * | 9/1998 | Geus et al. | 425/66 |
| 6,379,136 | B1 | 4/2002 | Najour et al. | |
| 6,402,492 | B1 * | 6/2002 | Achterwinter et al. | 425/72.2 |
| 2003/0161904 | A1 * | 8/2003 | Geus et al. | 425/72.2 |

FOREIGN PATENT DOCUMENTS

| | | |
|---|---|---|
| DE | 34 01 639 A1 | 7/1985 |
| DE | 37 40 893 A1 | 11/1988 |

* cited by examiner

*Primary Examiner* — Joseph Del Sole
*Assistant Examiner* — Joseph Leyson
(74) *Attorney, Agent, or Firm* — Alston & Bird LLP

(57) ABSTRACT

The invention relates to a device for depositing synthetic fibers to form a non-woven web. The fibers are transported through a take-off nozzle by means of an air stream in the direction of a depositing belt. The device is provided with a guide duct for guiding fibers from the take-off nozzle to the depositing belt, said duct having a mobile retaining flap on one end of a longitudinal side that faces the depositing belt. To obtain a depositing area on the depositing belt that is separate from the environment as the position of the retaining flap is modified, the retaining flap is formed by a support and an elastic sealing lip, which is held in frictional contact with the depositing belt.

23 Claims, 4 Drawing Sheets

DEVICE FOR DEPOSITING SYNTHETIC FIBERS TO FORM A NONWOVEN WEB

BACKGROUND OF THE INVENTION

The invention relates to a device for depositing synthetic fibers to form a non-woven web. In the production of spunbond non-woven webs, freshly spun synthetic fibers are usually drawn off by means of a take-off nozzle of a spinneret and conveyed for being stacked on a depositing belt. The processes of guiding and conveying the fibers are brought about by means of an air stream of the take-off nozzle, which air stream is absorbed and discharged by exhaust equipment disposed below the depositing belt. The fibers accumulating on the surface of the depositing belt result in a non-woven web, which is conveyed continuously by the depositing belt. The formation of the non-woven web depends on the impingement of the fibers on the depositing belt and the belt speed. A change in the airflow can influence the impingement of the fibers, in particular.

Thus, for example, DE 37 40 893 A1 discloses a device for depositing synthetic fibers to form a non-woven web, in which device a plurality of mobile retaining flaps is disposed in a guide duct arranged upstream of the depositing belt in order to influence firstly the airflow of the take-off nozzle and secondly the airflow when the fibers impinge on the depositing belt. Thus the guide duct comprises, on each of its ends that face the depositing belt, a pivoting retaining flap that can be held at various angles of incidence relative to the depositing belt.

However, the disadvantage of the device disclosed is that slots are formed between the ends of the guide duct and the depositing belt. Such slots result in the exhaust equipment sucking in a substantial portion of the ambient air together with the supplied air stream. This results in increased air consumption and, in particular, a direct influence of the fiber depositing for forming the non-woven web. There exists the risk of obtaining so-called drifts in the non-woven web.

U.S. Pat. No. 6,379,136 discloses a device for depositing synthetic fibers to form a non-woven web, in which device the depositing area of the fibers at the end of the guide duct is sealed from the ambience by sealing rollers. However, the disadvantage of this device is that the fibers can only be stacked in a depositing area, which is kept constant. It is not possible to change the depositing area on the depositing belt.

It is now an object of the invention to further improve a device of the generic kind for depositing synthetic fibers to form a non-woven web such that the depositing of the fibers can be controlled with the maximum flexibility possible and without substantial external influences.

Another aim of the invention is to provide a device for depositing synthetic fibers to form a non-woven web with which device it is possible to produce non-woven webs having reproducible non-woven web qualities.

SUMMARY OF THE INVENTION

These aims and others are achieved according to the invention by providing a device for depositing synthetic fibers to form a non-woven web comprising a take-off nozzle through which the fibers are downwardly conveyed by means of an air stream, a depositing belt moveable in a conveying direction and underlying the take off nozzle so as to receive the downwardly conveyed fibers and form a non-woven web thereupon, a guide duct comprising a pair of parallel duct walls extending between the take-off nozzle and the depositing belt and extending transverse to the conveying direction of the depositing belt, with at least one of the duct walls comprising a displaceable retaining flap which includes a support and an elastic sealing lip which is held in frictional contact with the depositing belt, and an exhaust duct disposed adjacent the underside of the depositing belt so as to be aligned below the guide duct.

The invention is characterized in that there is a seal on the longitudinal side of the guide duct between the depositing belt and the end of the guide duct, which seal shields the depositing area from the ambience. The elasticity of the sealing lip brings about a pre-stress which firstly prevents the sealing lip from being lifted off or separated during its frictional contact with the depositing belt. Secondly, the sealing lip can advantageously compensate for unevenness on the depositing belt. It is thus possible to prevent external air from being sucked in.

In order to shield the depositing area on the depositing belt as completely as possible, the guide duct comprises, on its opposite longitudinal side, a second mobile retaining flap, which is formed by a second support and a second elastic sealing lip, which is held in frictional contact with the non-woven web stacked on the depositing belt during operation according to an advantageous refinement of the invention. It is thus possible to achieve advantageously a high sealing effect in relation to the entry of external air on that longitudinal side of the guide duct, on which the non-woven web is guided from the depositing area. The fibers are thus stacked substantially without any influences of suctioned ambient air. Additionally, the adjustability of the retaining flaps relative to the depositing belt is completely retained. For this purpose, the support with the elastic sealing lip held thereon is guided in various positions relative to the depositing belt. The adjustability of the supports and the sealing lips provides the possibility of influencing the depositing angle and the entire depositing pattern of the fibers. Thus broad or narrow depositing areas can be adjusted on the depositing belt.

The sealing lips are connected replaceably to the supports according to an advantageous refinement of the invention so as to be able to carry out the appropriate maintenance work rapidly in the case of worn out sealing lips.

In order to achieve the longest possible service life, the sealing lips are preferably formed of a thin steel sheet, the free end of which lies on the depositing belt or the non-woven web.

For the purpose of further improvement, there also exists the possibility of designing the sealing lips at least in the area of contact with a wear protection. If a steel sheet is used for the sealing lips, the latter can be provided with a special coating in the area of contact.

In order to adjust the depositing area on the depositing belt, it has proved to be particularly useful to have pivoting supports and to assign an actuator to each of the supports. It is possible by means of the actuators to change and adjust an angle of incidence formed between the depositing belt and the sealing lip. It is thus possible to specify random and reproducible angles of incidence at the guide duct.

The flexibility of the adjustability for depositing the fibers can be increased advantageously by holding the guide duct by means of a bracket below the take-off nozzle, the holding elements located opposite to one another in the longitudinal sides enabling a displacement and adjustment of the associated duct elements. It is thus possible to influence the depositing directly when the fibers leave the take-off nozzle.

In order to influence the shape of the fiber depositing in addition to the depositing area, an adjustable suction opening is designed below the depositing belt, by means of which suction opening the exhaust equipment is connected to the lower side of the depositing belt.

The suction opening can be formed advantageously between two cover sheets, which are held displaceably relative to one another, so as to be able to stack the fibers very compactly e.g., in the case of a narrow suction opening or in an expanded manner in the case of a corresponding broad suction opening.

In order to prevent the non-woven web from being lifted off from the depositing belt outside of the depositing area, a suction slot formed between the cover sheets and the depositing belt has proved to be particularly useful, which suction slot leads to a defined suction of external air from the areas outside of the depositing area.

The suction slot formed between the cover sheets and the depositing belt is preferably designed to be adjustable so as to be able to adapt the quantity of the external air sucked in to the process parameters individually. This adjustability can be realized by adjusting the height of the cover sheets.

In a particularly proven and tested refinement of the invention, a plurality of spacers is disposed between the cover sheets and the depositing belt, which spacers have a rounding—preferably a crescent-shaped cross-section on their topsides facing the depositing belt so as to ensure a support and guidance of the depositing belt. Between the lower sides of the spacers and the cover sheets, a suction slot is formed in each case, through which only a defined quantity of external air can enter into the exhaust area. The suction gap is adjusted preferably in the range of 1 to 1.5 mm.

For further improving the flexibility of the adjustability, it is possible in another preferred refinement of the invention, to change and adjust a depositing height between the take-off nozzle and the depositing belt.

It is possible to implement differences in height by replacing the sealing lips or by changing the angle of incidence of the retaining flaps.

The device of the invention is thus characterized by the maximum flexibility for depositing non-woven webs. The desired setting parameters can be adjusted for producing a defined non-woven web depending on the fiber type, fiber material and non-woven web requirements. It is possible to carry out the adjustments by means of controllable actuators, which are activated automatically, for example, by means of a control device according to the specifications of process parameters.

BRIEF DESCRIPTION OF THE DRAWINGS

Figure 1:
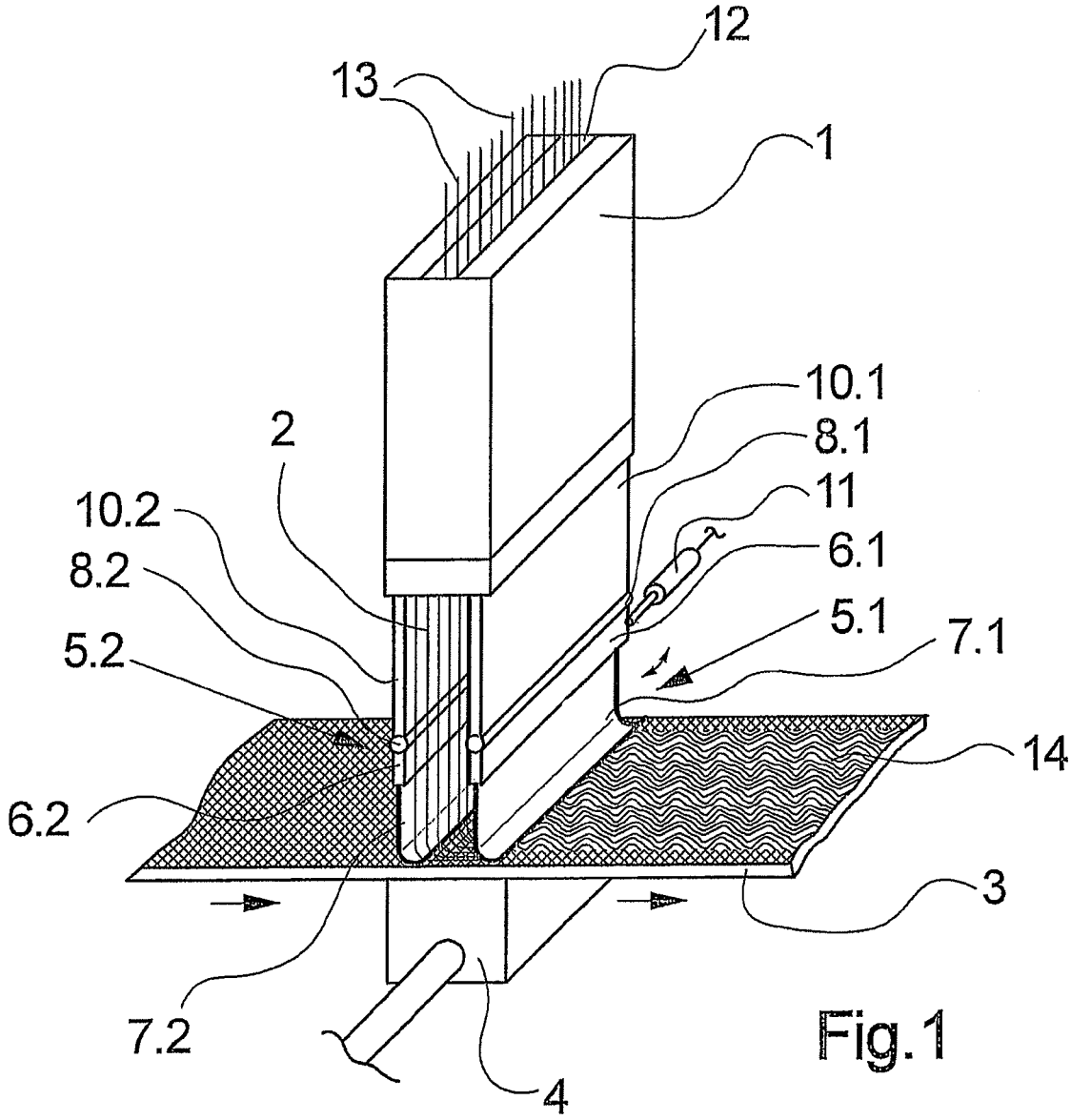
Figure 2:
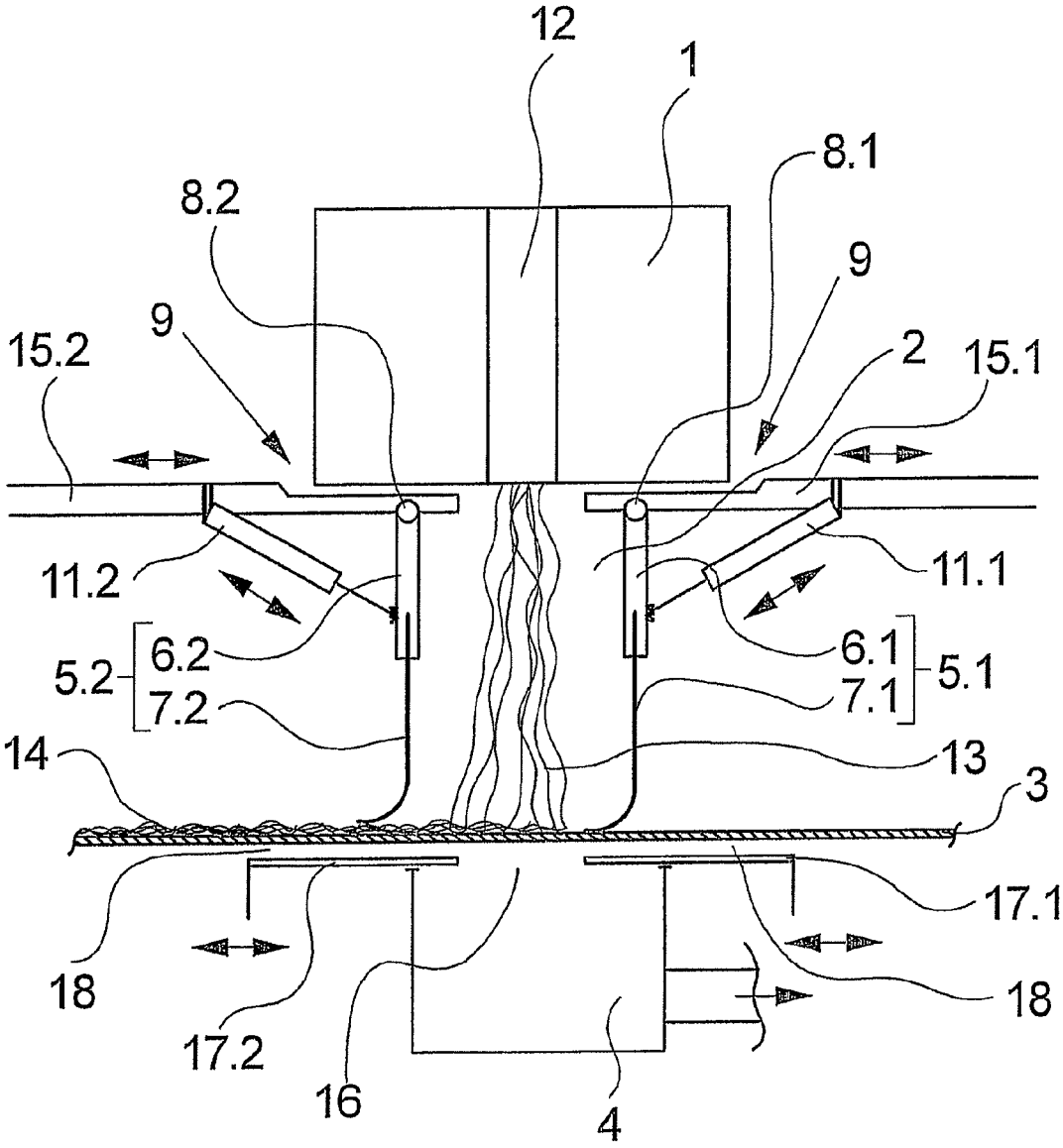
Figure 3:
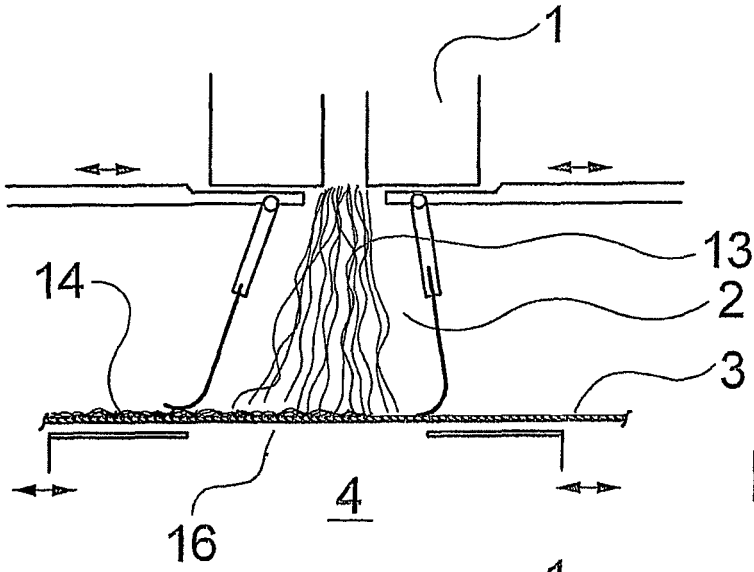
Figure 4:
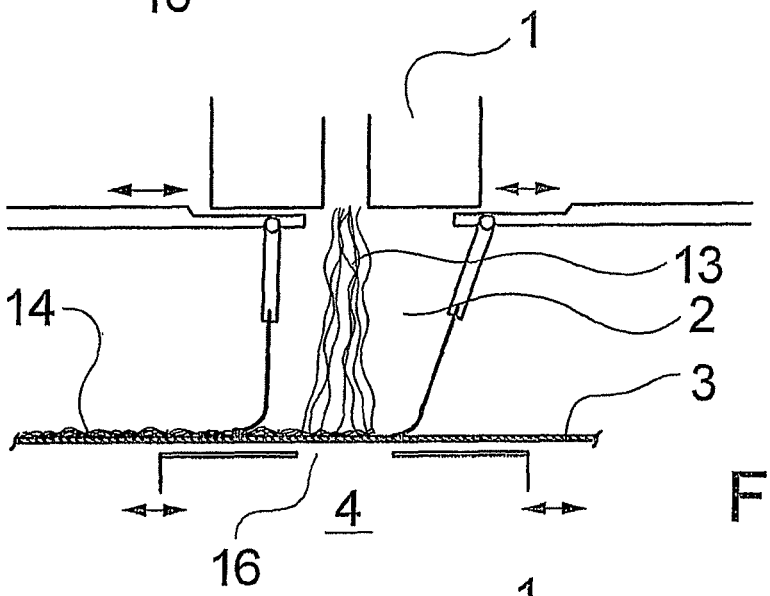
Figure 5:
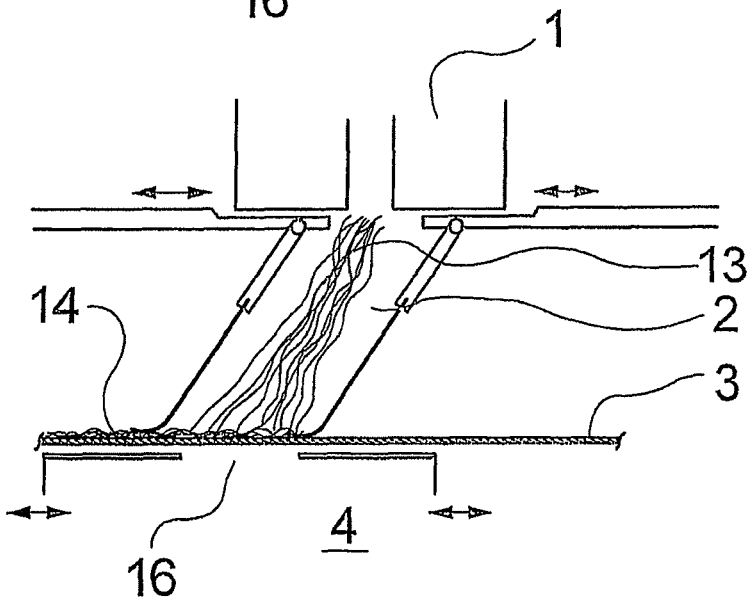
Figure 6:
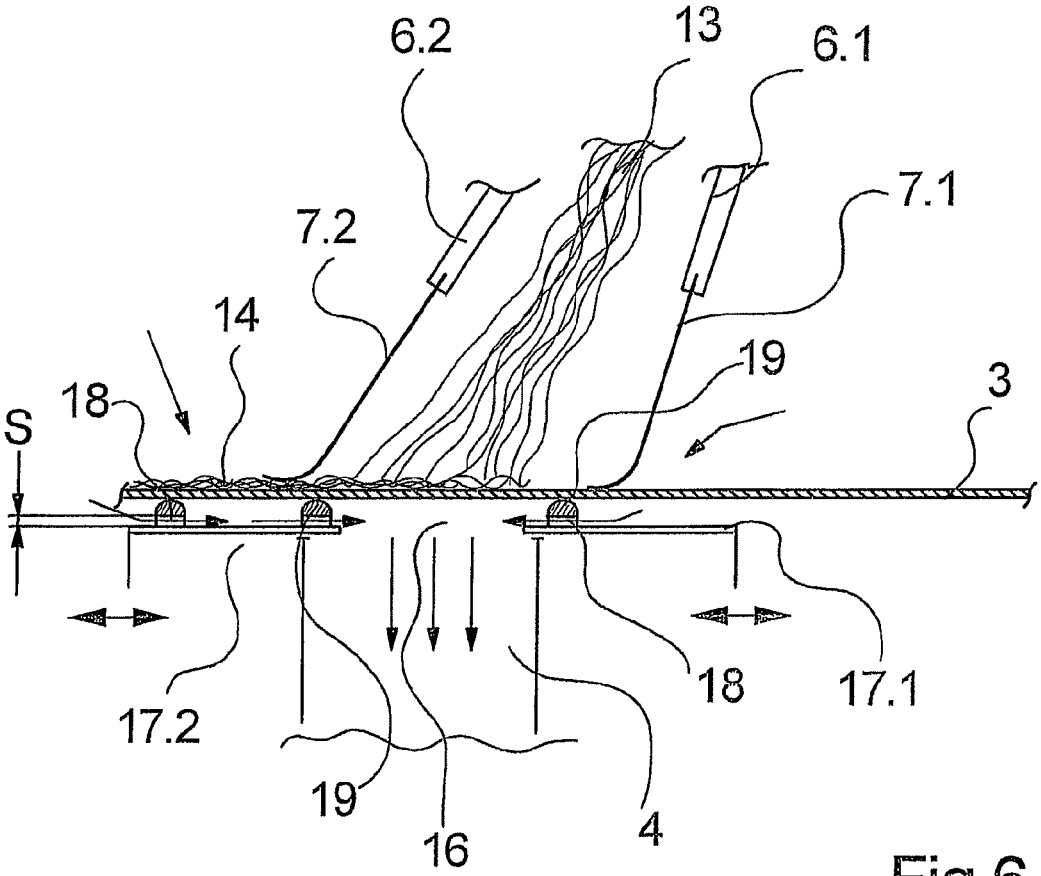

Having thus described the invention in general terms, reference will now be made to the accompanying drawings, which are not necessarily drawn to scale, and wherein:

FIG. 1 shows a schematic view of a first exemplary embodiment of the device of the FIG. 2 shows a schematic cross-sectional view of another exemplary embodiment of the device of the invention;

FIG. 3 shows an operation setting of an exemplary embodiment of the device of the invention;

FIG. 4 shows an operation setting of another exemplary embodiment of the device of the invention;

FIG. 5 shows an operation setting of another exemplary embodiment of the device of the invention; and FIG. 6 shows a schematic cross-sectional view of another exemplary embodiment of the device of the invention.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

FIG. 1 schematically shows a first exemplary embodiment of the device of the invention for depositing synthetic fibers to form a non-woven web.

The exemplary embodiment shown in FIG. 1 shows a parallelepiped take-off nozzle 1 with a central fiber channel 12. A plurality of fibers 13 is guided in a row in the fiber channel 12. The fibers 13 are spun previously by means of a spinneret (not shown) from a synthetic polymer melt.

Compressed air is supplied into the take-off nozzle 1 in the fiber channel 12 so as to draw off the fibers 13 continuously from the spinneret and convey them on an outlet side of the take-off nozzle 1. A guide duct 2 and a depositing belt 3 disposed at the end of the guide duct 2 are provided on the outlet side of the take-off nozzle 1. The guide duct 2 comprises two opposing duct walls 10.1 and 10.2, which are disposed substantially parallel to the fiber channel 12 of the take-off nozzle 1. The duct walls 10.1 and 10.2 are held on the outlet side of the take-off nozzle 1 such that they preferably form a seal with the same.

Two retaining flaps 5.1 and 5.2 are each disposed in the extension of the duct walls 10.1 and 10.2 on the longitudinal sides of the guide duct 2. The retaining flaps 5.1 and 5.2 are each formed by a support 6.1 and 6.2 and a sealing lip 7.1 and 7.2 connected replaceably to each of the supports 6.1 and 6.2. The supports 6.1 and 6.2 can each be displaced within an angle of incidence by means of pivot axes 8.1 and 8.2. The angle of incidence represents the angle formed between the depositing belt 3 and the retaining flap 5.1 and 5.2. The sealing lips 7.1 and 7.2 are designed to be elastic such that a lower end of the sealing lips 7.1 and 7.2 is in frictional contact with the depositing belt 3 or the non-woven web 14 guided on the depositing belt 3. The area of the depositing belt 3 within the guide duct 2 between the sealing lips 7.1 and 7.2 is referred to as the depositing area here.

The depositing belt 3 is connected to a drive equipment (not shown), by means of which the depositing belt 3 can be guided in a conveying direction indicated by the arrow. The depositing belt 3 is designed to be air-permeable so that the air stream of the take-off nozzle 1 permeates the depositing belt 3. For discharging and supporting the fiber depositing for forming the non-woven web, exhaust equipment 4 is disposed on the lower side of the depositing belt 3. The exhaust effect of the exhaust equipment 4 is limited to the depositing area within the guide duct 2.

The exemplary embodiment of FIG. 1 shows that operating situation, in which the fibers 13 are continuously guided through the take-off nozzle 1 into the fiber channel 12 and are conveyed to the depositing belt 3. The fibers 13 pass through the guide duct 2. The displaceable retaining flaps 5.1 and 5.2 on the longitudinal sides of the guide duct 2 firstly seal the depositing area of the depositing belt 3 from the surroundings of the longitudinal sides and secondly determine the location of the depositing area on the depositing belt 3. For this purpose, the sealing lips 7.1 and 7.2 that are held on the supports 6.1 and 6.2 abut resiliently against the surface of the depositing belt 3 or of the non-woven web 14 conveyed by the depositing belt 3. The frictional contact between the sealing lips 7.1 and 7.2 and the depositing belt 3 or the non-woven web 14 prevents external air from being sucked into the depositing area over the entire width of the non-woven web 14. The fibers 13 are stacked exclusively under the effect of the airflow and the exhaust effect within the guide duct 2.

In the exemplary embodiment shown in FIG. 1, the front sides of the guide duct 2 are not sealed. In principle, however, it is also possible to seal the front sides of the guide duct 2 from the surrounding environment.

In the exemplary embodiment shown in FIG. 1, actuators 11 are assigned to each of the retaining flaps 5.1 and 5.2 by means of which actuators it is possible to adjust and change the angle of incidence at the end of the guide duct 2. In principle, however, it is also possible to position such moveably disposed retaining flaps 5.1 and 5.2 using manual control equipment. It is essential for the adjustment to take place by means of the supports 6.1 and 6.2. The sealing lips 7.1 and 7.2 held on the supports 6.1 and 6.2 are used exclusively for tightly abutting against the depositing belt 3 or the non-woven web 14.

FIG. 2 schematically shows a cross-sectional view of another exemplary embodiment of the device of the invention for depositing synthetic fibers to form a non-woven web. The exemplary embodiment shown in FIG. 2 is substantially identical to that of the preceding exemplary embodiment. Hence only the differences therebetween are explained in the following description. A depositing height that is smaller in relation to that of the preceding exemplary embodiment is adjusted between the take-off nozzle 1 and the depositing belt 3 for depositing the fibers 13. For this purpose, the take-off nozzle 1 is designed to be adjustable in height.

The guide duct 2 disposed between the take-off nozzle 1 and the depositing belt 3 is formed in this exemplary embodiment by two retaining flaps 5.1 and 5.2 disposed on opposite sides. The retaining flap 5.1 comprises a support 6.1, which is pivoted on the pivot axis 8.1. The pivot axis 8.1 is disposed on a holding element 15.1 of the bracket 9. The bracket 9 is mounted on the outlet side of the take-off nozzle 1. A sealing lip 7.1, for example, in the form of a steel sheet, is attached replaceably to the free end of the support 6.1. The length of the sealing lip 7.1 is measured such that the lower end of the sealing lip 7.1 is in frictional contact with the depositing belt 3. An actuator 11.1 engages at the support 6.1, by means of which actuator the support 6.1 can be pivoted about the pivot axis 8.1.

The retaining flap 5.2 is disposed by means of the support 6.2 and the sealing lip 7.2 on the opposite longitudinal side of the guide duct 2. The support 6.2 is guided on the pivot axis 8.2, the pivot axis 8.2 being disposed on the holding element 15.2. A sealing lip 7.2 is attached replaceably to the free end of the support 6.2. The free end of the sealing lip 7.2 is in frictional contact with a non-woven web 14 guided on the depositing belt 3. The sealing lip 7.2 could likewise be designed in the form of a steel sheet, for example, with a thickness of 0.2 mm. An actuator 11.2 engages at the support 6.2, by means of which actuator it is possible to pivot and position the support about the pivot axis 8.2.

The opposing holding elements 15.1 and 15.2 form the bracket 9. The holding elements 15.1 and 15.2 are designed to be displaceable horizontally so as to be able to adjust the width of the guide duct 2 transversely to the conveying direction of the fibers.

When changing the depositing height between the take-off nozzle 1 and the depositing belt 3, it is possible to compensate for the length adjustment in the guide duct 2 either by replacing the sealing lips 7.1 and 7.2 with appropriately shorter or longer sealing lips or by changing the angle of incidence of the supports 6.1 and 6.2.

The exhaust equipment 4 is designed below the depositing belt 3. The exhaust equipment 4 comprises an adjustable suction opening 16, which is assigned directly to the depositing area on the depositing belt 3. The suction opening 16 is formed between two displaceably disposed cover sheets 17.1 and 17.2. The cover sheets 17.1 and 17.2 can each be displaced horizontally relative to one another. A minimum suction gap 18 is formed between the cover sheets 17.1 and 17.2 and the depositing belt 3. The suction gap 18 is measured such that external air can be sucked outside of the depositing area above the depositing belt 3. It is thus possible to prevent the non-woven web 14 from being lifted off from the depositing belt 3 in particular, in the area of the guidance of the non-woven web. An additional exhaust equipment in the conveying direction of the non-woven web 14 can thus be dispensed with. In order to suck in the least possible and most defined possible quantity of external air, the suction gap 18 is designed to be adjustable, for example, by adjusting the height of the cover sheets 17.1 and 17.2.

The functioning of the exemplary embodiment shown in FIG. 2 is identical to that of the preceding exemplary embodiment. Hence reference may be made to the preceding description. However, due to the flexible design of the guide duct 2, a plurality of adjustment possibilities can be implemented in order to achieve a special depositing of the fibers and thus a defined non-woven web. The adjusting movements of the holding elements 15.1 and 15.2, the take-off nozzle 1, the cover sheets 17.1 and 17.2 could be carried out automatically by actuators, which can be controlled, for example, using central control equipment. There thus exists the possibility of carrying out an automatic adjustment of the different actuators according to specified product and process parameters.

FIGS. 3 to 5 show some variants of the operating settings of the device shown in FIG. 2.

It is thus possible, for example, to implement a relatively broad depositing area, by holding the retaining flaps 5.1 and 5.2 such that they can each be pivoted outwardly as shown in FIG. 3. An appropriately large suction opening 16 on the lower side of the depositing belt 3 thus leads to an expansion of the fibers during their depositing, thereby eliminating the possibility of a relatively loose non-woven material.

FIG. 4 shows an operation setting of the device shown in FIG. 2, in which setting the retaining flaps 5.1 and 5.2 define a relatively narrow depositing area on the depositing belt 3. As a result, a relatively narrow depositing area is created on the depositing belt 3 with an appropriately small suction opening 16. The fibers 13 are stacked almost vertically on the depositing belt 3 so as to be able to produce particularly compact and firm non-woven webs.

FIG. 5 schematically shows another possibility of an operation setting of the device shown in FIG. 2. Here, a relatively broad depositing area is created on the depositing belt which depositing area is disposed laterally offset to the outlet side of the take-off nozzle. The fibers are thus stacked at a relatively low angle on the depositing belt 3.

The operation settings of FIG. 3 to 5 show only a small belt width of the possible adjustment variants of the device of the invention. The common feature of all the operation settings of the device of the invention is that the inflow of external air when depositing the fibers is reduced to a minimum. The frictional contact between the sealing lips 7.1 and 7.2 and the depositing belt 3 and the non-woven web 14 creates a sealing effect, which prevents external air from being sucked in. The longitudinal sides of the guide duct 2 are thus substantially sealed from the ambience.

FIG. 6 schematically shows a cross-sectional view of another exemplary embodiment. Only a section of the depositing belt is shown in this exemplary embodiment. The components that are not shown are identical to those of the preceding exemplary embodiments, thereby making it possible to dispense with another explanation at this point.

In order to firstly influence the inflow of external air in a targeted manner and secondly achieve a stable guidance of the depositing belt, a plurality of spacers 19 is disposed at a distance from one another between the depositing belt 3 and the cover sheets 17.1 and 17.2 disposed below the depositing belt 3 in the exemplary embodiment shown. The spacers 19 comprise a rounding on their topsides that face the depositing belt 3. For this purpose, the spacers 19 are designed preferably with a crescent-shaped cross-section and they extend in the form of bars substantially over the entire width of the depositing belt 3. It is thus possible to ensure the support and guidance of the depositing belt 3 relative to the suction slot 18 formed. The distance between the lower side of the spacers 19 and the topside of the cover sheets 17.1 and 17.2 form the suction slot 18. The suction slot 18 is indicated by the slot height having the reference symbol S in FIG. 6. The slot height is preferably adjusted to a max. of 1 mm to 1.5 mm.

The distance between the spacers 19 below the depositing belt 3 is selected such that at least one spacer 19 is disposed on each of the two sides of the suction opening 16. The spacers 19 disposed on both the sides of the suction opening 16 are present within the depositing area formed by the sealing lips 7.1 and 7.2 abutting against the surface of the depositing belt 3. The spacers 19 could additionally be designed to be replaceable in order to be able to adjust various heights of the suction slot 18.

The exemplary embodiment of the device of the invention shown in FIG. 6 is thus particularly characterized in that a small quantity of external air arrives from the ambience into the exhaust equipment. The suction slots on the depositing side, in particular, are selected in such a way that the suction of external air is sufficient to ensure a firm abutment of the non-woven web against the depositing belt.

The structure and design of the components of the exemplary embodiments are shown in FIGS. 1 to 6 by way of example. The invention thus extends to all similar devices in which those mobile duct walls of a guide duct that face the depositing belt are held in frictional contact with the depositing belt by means of sealing lips.

The exemplary embodiments according to FIGS. 1, 2 and 6 could be modified such that the front sides can also be shielded by means of additional shielding means. Such shielding means could thus influence the depositing of the non-woven web particularly on the edges of the depositing belt. Furthermore, it is also possible to achieve additional external air effects.

Another variant of the device of the invention can also be implemented by an automatic actuator control of the retaining flaps or of the cover sheets. It is thus possible to select a plurality of process settings rapidly and reproducibly in order to achieve optimum operating conditions depending on the type of the fibers and non-woven webs.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A device for depositing synthetic fibers to form a non-woven web comprising a take-off nozzle through which the fibers are downwardly conveyed by means of an air stream, a depositing belt moveable in a conveying direction and underlying the take-off nozzle so as to receive the downwardly conveyed fibers and form a non-woven web thereupon, a guide duct comprising a pair of parallel duct walls extending between the take-off nozzle and the depositing belt and extending transverse to the conveying direction of the depositing belt, with at least one of the duct walls comprising a displaceable retaining flap which includes a support and an elastic sealing lip which is held in frictional contact with the depositing belt, and an exhaust duct disposed adjacent the underside of the depositing belt so as to be aligned below the guide duct.

2. The device according to claim 1, wherein the other of the duct walls comprises a second displaceable retaining flap which includes a second support and a second elastic sealing lip which is held in frictional contact with the non-woven web deposited on the depositing belt during operation.

3. The device according to claim 2, wherein the sealing lips are replaceably connected to the support.

4. The device according to claim 2, wherein the sealing lips are each formed by a thin steel sheet.

5. The device according to claim 2, wherein the sealing lips have wear protection at least in the area of contact.

6. The device according to claim 2 further comprising an actuator connected to each of the supports by means of which actuators it is possible to change and adjust an angle of incidence formed between the depositing belt and the sealing lips.

7. The device according to claim 1, wherein each of said duct walls is mounted to a bracket which is supported below the take-off nozzle for back and forth movement in the conveying direction so as to permit adjustment of the separation of the duct walls.

8. The device according to claim 1 wherein the exhaust duct defines a suction opening below the depositing belt, with the suction opening being defined between a pair of cover plates which are each mounted for independent movement in the conveying direction.

9. The device according to claim 8 wherein the cover plates are mounted immediately below the underside of the depositing belt, with the spacing between the cover plates and the depositing belt being adjustable.

10. The device according to claim 9 further comprising a plurality of spacers positioned between the cover plates and the depositing belt so as to ensure a support and guidance of the depositing belt and so as to form a suction slot between lower sides of the spacers and the cover plates, with the spacers having a crescent-shaped cross section so as to form a rounded surface facing the depositing belt.

11. The device according to claim 1 wherein the device is structured such that separation of the take-off nozzle and depositing belt is adjustable.

12. A device for depositing synthetic fibers to form a non-woven web comprising:

a take-off nozzle through which the fibers are downwardly conveyed by means of an air stream, a depositing belt moveable in a conveying direction and underlying the take off nozzle so as to receive the downwardly conveyed fibers and form a non-woven web thereupon, a guide duct comprising a pair of parallel duct walls extending between the take-off nozzle and the depositing belt and extending transverse to the conveying direction of the depositing belt, with at least one of the duct walls comprising a displaceable retaining flap which includes a support and an elastic sealing lip which is held in frictional contact with the depositing belt, an exhaust duct disposed adjacent the underside of the depositing belt so as to be aligned below the guide duct, the exhaust duct defining a suction opening below the depositing belt, with the suction opening being defined between a pair of cover plates, and a plurality of spacers positioned between the cover plates and the depositing belt so as to ensure a support and guidance of the depositing belt and so as to form a suction slot between lower sides of the spacers and the cover plates.

13. The device according to claim 12, wherein the other of the duct walls comprises a second displaceable retaining flap which includes a second support and a second elastic sealing lip which is held in frictional contact with the non-woven web deposited on the depositing belt during operation.

14. The device according to claim 13, wherein the sealing lips are replaceable connected to the support.

15. The device according to claim 13, wherein the sealing lips are each formed by a thin steel sheet.

16. The device according to claim 13, wherein the sealing lips have wear protection at least in the area of contact.

17. The device according to claim 13 further comprising an actuator connected to each of the supports by means of which actuators it is possible to change and adjust an angle of incidence formed between the depositing belt and the sealing lips.

18. The device according to claim 12, wherein each of said duct walls is mounted to a bracket which is supported below the take-off nozzle for back and forth movement in the conveying direction so as to permit adjustment of the separation of the duct walls.

19. The device according to claim 12 wherein at least one cover plate is mounted for independent movement in the conveying direction.

20. The device according to claim 12 wherein each cover plate is mounted for independent movement in the conveying direction.

21. The device according to claim 12 wherein the cover plates are mounted immediately below the underside of the depositing belt, with the spacing between the cover plates and the depositing belt being adjustable.

22. The device according to claim 12 wherein the spacers have a crescent-shaped cross section so as to form a rounded surface facing the depositing belt.

23. The device according to claim 12 further comprising means for adjusting the separation of the take-off nozzle and depositing belt.

* * * * *

UNITED STATES PATENT AND TRADEMARK OFFICE

CERTIFICATE OF CORRECTION

PATENT NO. : 8,137,088 B2
APPLICATION NO. : 11/575843
DATED : March 20, 2012
INVENTOR(S) : Galliano Boscolo et al.

It is certified that error appears in the above-identified patent and that said Letters Patent is hereby corrected as shown below:

Title page,

Item (73) Assignee: "OERLIKON TEXTILE GMBH & CO. KG" should read
-- ALBIS S.P.A. --.

Signed and Sealed this
Nineteenth Day of June, 2012

David J. Kappos
*Director of the United States Patent and Trademark Office*

UNITED STATES PATENT AND TRADEMARK OFFICE

CERTIFICATE OF CORRECTION

PATENT NO. : 8,137,088 B2
APPLICATION NO. : 11/575843
DATED : March 20, 2012
INVENTOR(S) : Boscolo et al.

It is certified that error appears in the above-identified patent and that said Letters Patent is hereby corrected as shown below:

Column 3,
Line 52, "embodiment of the device of the" should read
--embodiment of the device of the invention;--.

Signed and Sealed this
Twenty-fifth Day of September, 2012

David J. Kappos

David J. Kappos
*Director of the United States Patent and Trademark Office*